US007775652B2

(12) United States Patent
Taira et al.

(10) Patent No.: US 7,775,652 B2
(45) Date of Patent: Aug. 17, 2010

(54) LAYERED STRUCTURE AND INK-JET HEAD INCLUDING THE SAME

(75) Inventors: Hiroshi Taira, Ichinomiya (JP); Tatsuo Terakura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 556 days.

(21) Appl. No.: 11/612,167

(22) Filed: Dec. 18, 2006

(65) Prior Publication Data

US 2007/0139484 A1 Jun. 21, 2007

(30) Foreign Application Priority Data

Dec. 16, 2005 (JP) ..... 2005-362832

(51) Int. Cl.
*B41J 2/175* (2006.01)
*B41J 2/045* (2006.01)

(52) U.S. Cl. ..... 347/93; 347/71

(58) Field of Classification Search ..... 347/68–72, 347/93; 210/448, 459, 460
See application file for complete search history.

(56) References Cited

U.S. PATENT DOCUMENTS 6,685,299 B2 * 2/2004 Hirota ..... 347/20
7,475,975 B2 * 1/2009 Shimizu ..... 347/93
2004/0179057 A1 9/2004 Yamada
2004/0257415 A1 * 12/2004 Arakawa et al. ..... 347/93
2005/0116989 A1 6/2005 Chikamoto

FOREIGN PATENT DOCUMENTS

JP 11277758 A 10/1999
JP 2002361893 A 12/2002
JP 2004174833 A 6/2004
JP 2004268454 9/2004
JP 2005-161617 A 6/2005

OTHER PUBLICATIONS

European Patent Office, European Search Report for EP Appl'n No. 06025833 (counterpart to above-captioned patent appl'n) mailed Apr. 5, 2007.
Japanese Patent Office, Notice of Reasons for Rejection for Japanese Patent Application No. 2005-362832, mailed Feb. 2, 2010.

* cited by examiner

*Primary Examiner*—Stephen D Meier
*Assistant Examiner*—Geoffrey Mruk
(74) *Attorney, Agent, or Firm*—Baker Botts L.L.P.

(57) ABSTRACT

A layered structure has a first metal plate having a first hole, a second metal plate having a second hole designed to communicate with the first hole, and a filter plate at least a surface of which is made of a metal. The filter plate is sandwiched between the first and second metal plates so that the first hole and the second hole communicate with each other through the filter. The first and second metal plates are bonded to each other by means of an adhesive that is disposed between the first and second metal plates. The adhesive is not opposed to the filter plate.

14 Claims, 13 Drawing Sheets

LAYERED STRUCTURE AND INK-JET HEAD INCLUDING THE SAME

BACKGROUND OF THE INVENTION

1. Field of the Invention

The present invention relates to a layered structure in which a filter plate is sandwiched between two metal plates, and also to an ink-jet head including the layered structure.

2. Description of Related Art

Japanese Patent Unexamined Publication No. 2004-268454 discloses an ink-jet head in which a joint member is bonded by an adhesive to a filter plate that is mounted on a head unit. The joint member has four cylinders and a flange integrally connected to the cylinders. The four cylinders have passages formed therein, and respectively communicate with four ink supply ports that are formed on the head unit. In portions of the filter plate opposed to the respective ink supply ports, many holes are formed. By an epoxy-base adhesive, the flange is bonded to such a region of the filter plate that encloses the holes. On a face of the flange which is to be bonded to the filter plate, a groove is formed so as to avoid openings of the passages that are formed in the respective cylinders. An adhesive used for bonding the flange to the filter plate enters the groove. After being solidified, the adhesive serves as a partition wall for partitioning the passages that are formed in the cylinders. This can prevent mixture of colors of ink flowing through the respective passages.

SUMMARY OF THE INVENTION

In the ink-jet head disclosed in the above-mentioned document, however, the filter plate is formed through an electroforming process, and made of a material different from 42 alloy which is a material of the head unit. If the filter plate and the head unit made of different materials are bonded by an adhesive, adhesion of the adhesive may not work well depending on a combination of materials and sometimes cannot endure external force which is applied after both are bonded. That is, depending on a material of the filter plate, it becomes impossible to sufficiently bond the joint member and the head unit to each other with the filter plate interposed therebetween. A conceivable measure is to reinforce a joint area by use of another member, but this increases a size of the ink-jet head as a whole.

An object of the present invention is to provide a layered structure that makes it difficult that two metal plates are separated from each other even though a filter plate is sandwiched therebetween, and also to provide an ink-jet head including the layered structure.

According to a first aspect of the present invention, there is provided a layered structure comprising a first metal plate having a first hole, a second metal plate having a second hole designed to communicate with the first hole, and a filter plate having a filter through which liquid is filtered and at least a surface of which is made of a metal. The filter plate is sandwiched between the first and second metal plates so that the first hole and the second hole communicate with each other through the filter. The first and second metal plates are bonded to each other by means of an adhesive that is disposed between the first and second metal plates. The adhesive is not opposed to the filter plate.

According to a second aspect of the present invention, there is provided an ink-jet head comprising a member where a plurality of nozzles and an ink passage communicating with the nozzles are formed. The member includes the layered structure described above, and the first and second holes form the ink passage.

In the above-described first and second aspects, the first and second metal plates are bonded to each other by means of the adhesive that is disposed between the first and second metal plates, the adhesive not opposed to the filter plate. Accordingly, even if adhesion of the adhesive to the filter plate is small, the first and second metal plates are firmly bonded and thus not easily separated from each other.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

In the following, a certain preferred embodiment of the present invention will be described with reference to the accompanying drawings.

Figure 1:
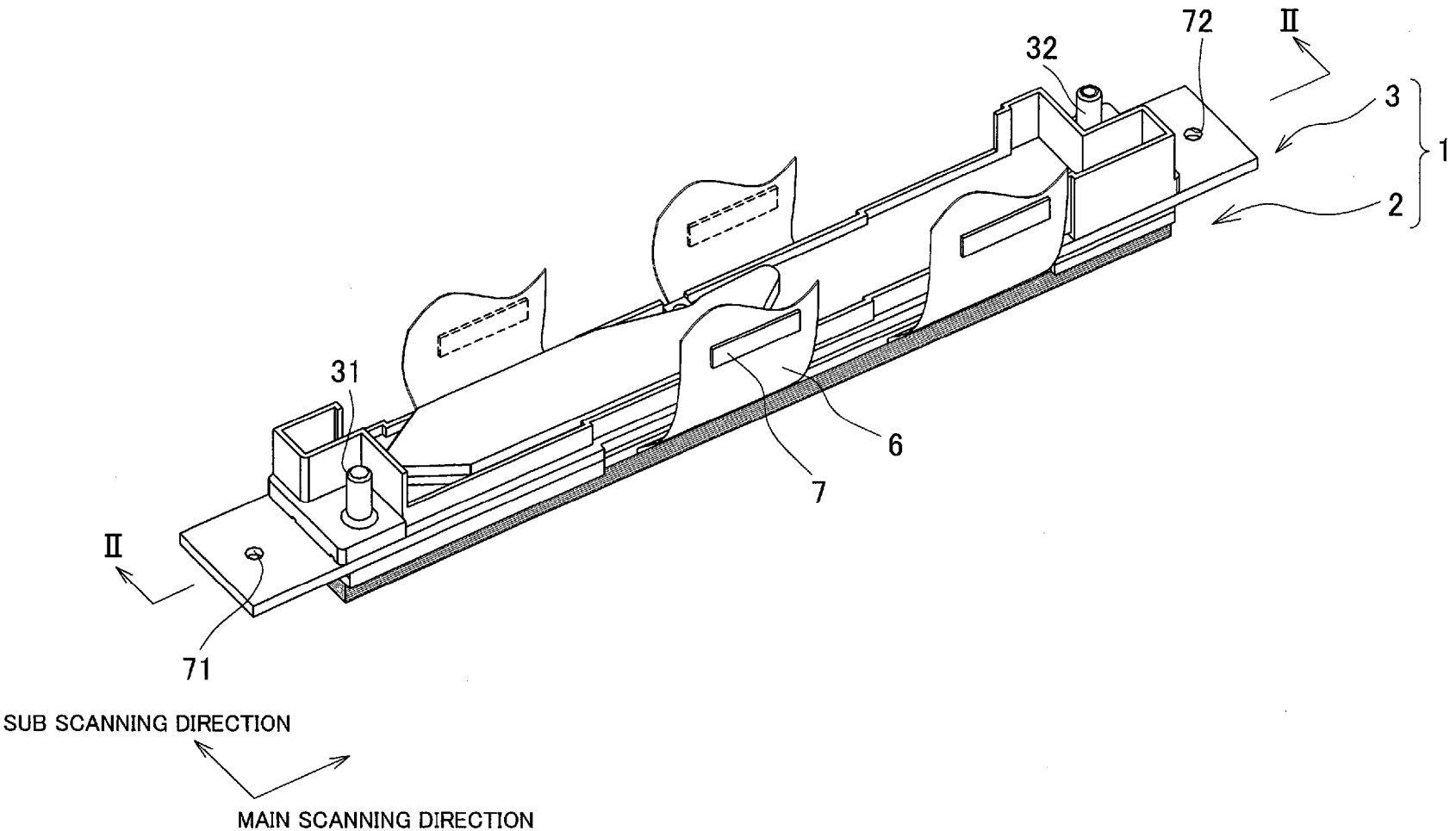
FIG. 1 is a perspective view of an external appearance of an ink-jet head that adopts a layered structure according to an embodiment of the present invention.

FIG. 1 is a perspective view of an external appearance of an ink-jet head that adopts a layered structure according to an embodiment of the present invention. As shown in FIG. 1, an ink-jet head 1 is elongated in a main scanning direction and has, from down to top, a head main body 2 and a reservoir unit 3. The head main body 2 is opposed to a record medium. The reservoir unit 3 temporarily stores ink therein. Four FPCs (Flexible Printed Circuits) 6, which work as power supply members, are put on an upper face of the head main body 2, and extend upward through a space between the head main body 2 and the reservoir unit 3. One end of the FPC 6 is connected to an actuator unit 21 which will be described later, and the other end thereof is connected to a control board (not shown). A driver IC 7 is mounted on the FPC 6 at a point midway from the actuator unit 21 to the control board. That is, the FPC 6 is electrically connected to the control board and to the driver IC 7, so that it transmits an image signal outputted from the control board to the driver IC 7 and supplies a drive signal outputted from the driver IC 7 to the actuator unit 21.

Figure 2:
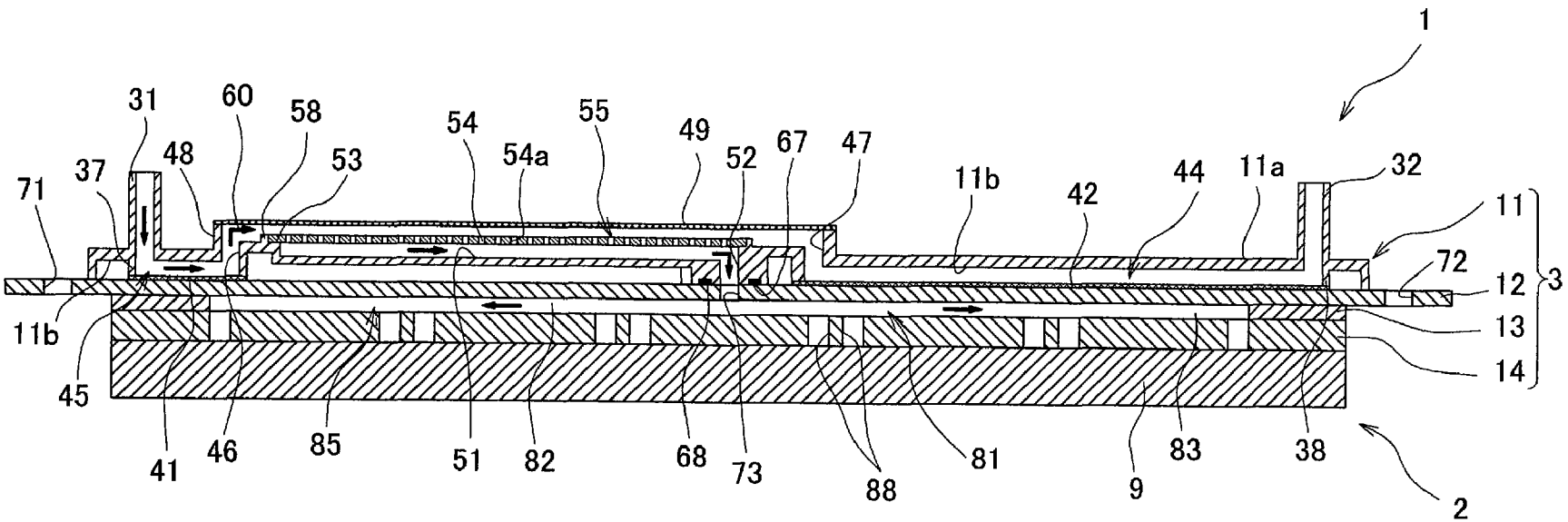
FIG. 2 is a sectional view as taken along a line II-II of FIG. 1.
Figure 3:
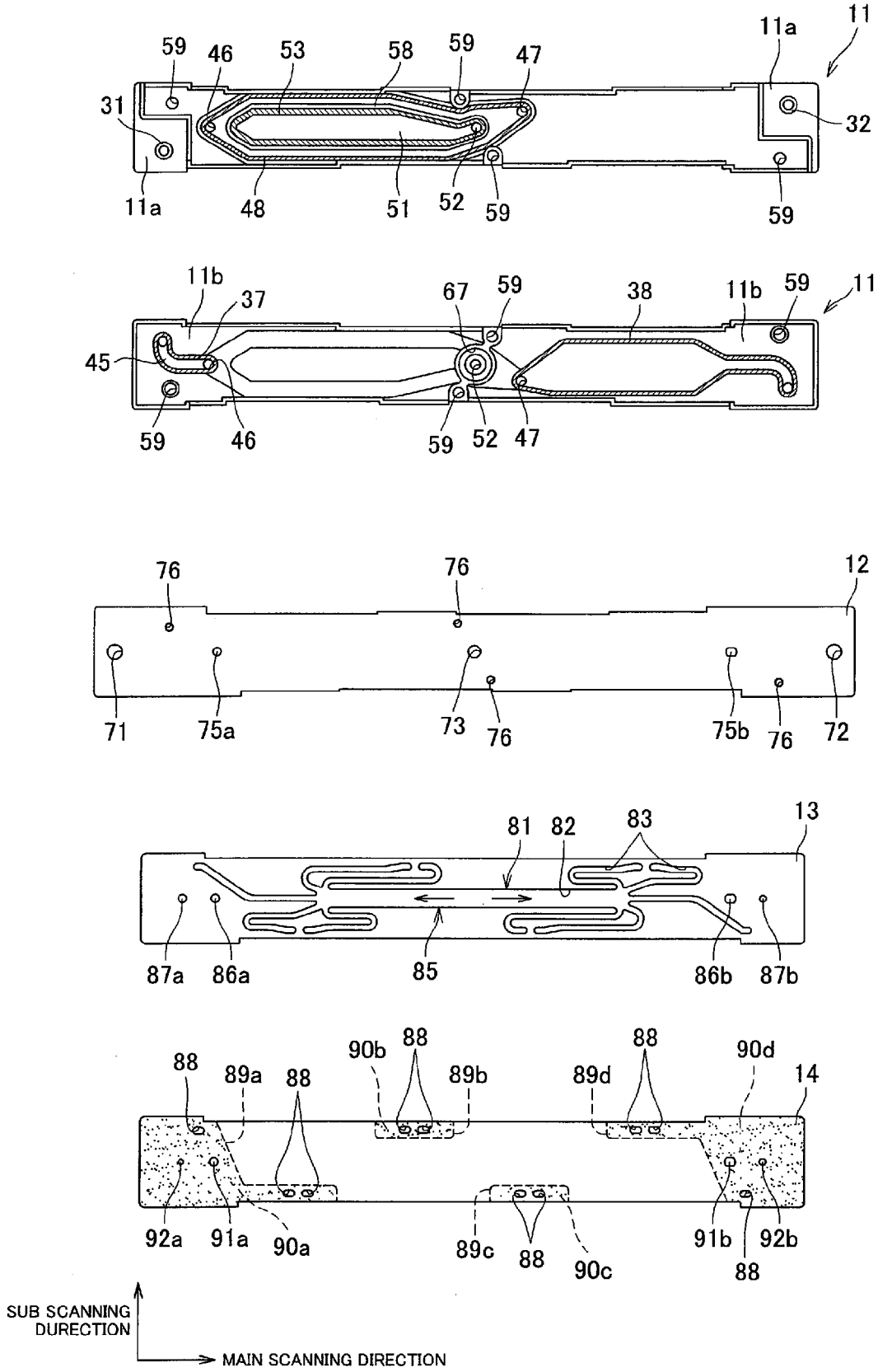
FIG. 3 is a set of exploded plan views of a reservoir unit that is included in the ink-jet head.
Figure 4:
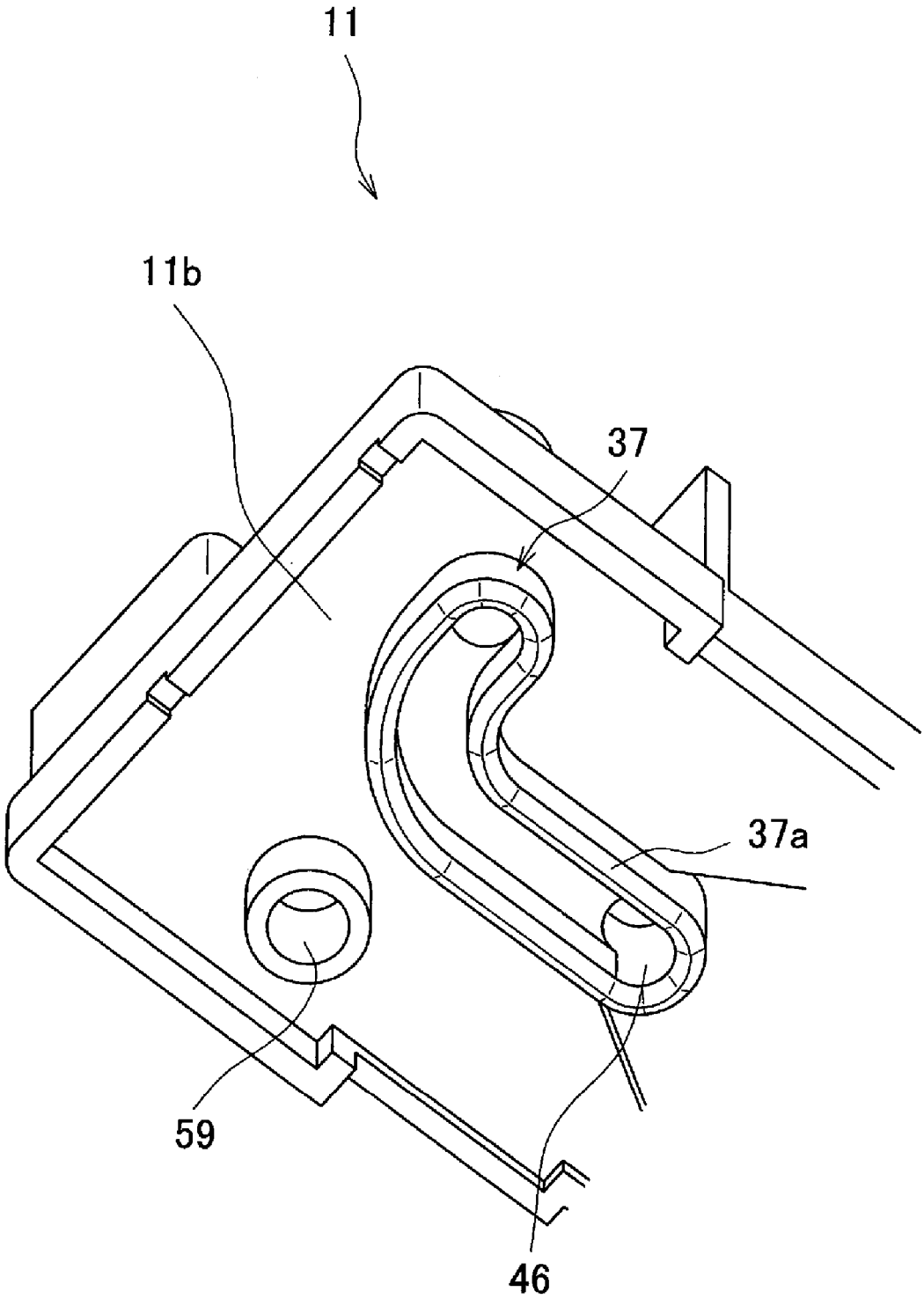
FIG. 4 is a perspective view of a part of a passage component that is included in the reservoir unit, as seen at an angle from below.
Figure 5:
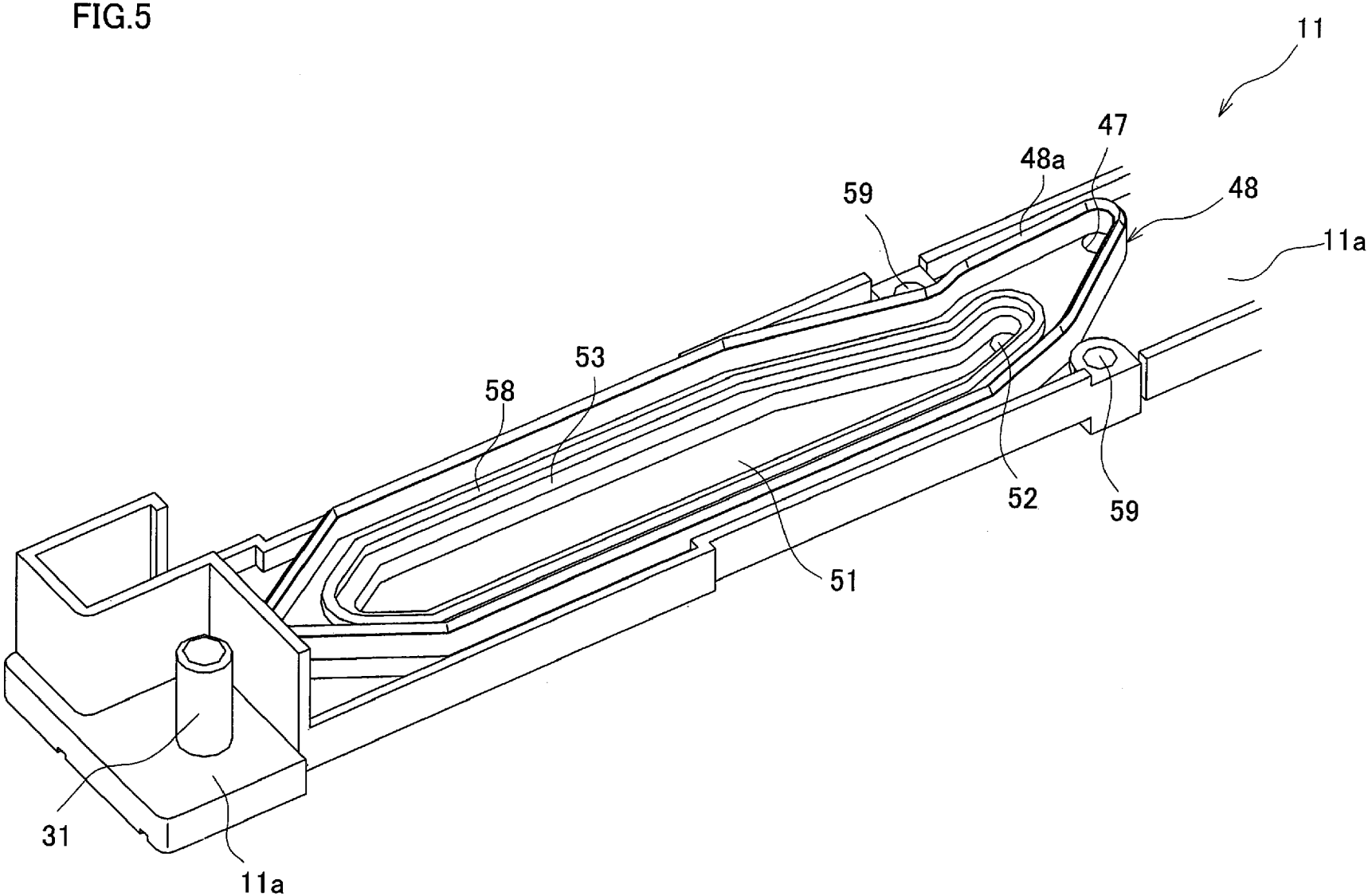
FIG. 5 is a perspective view of a part of the passage component, as seen at an angle from above.

FIG. 2 is a sectional view of the ink-jet head 1. FIG. 3 is a set of exploded plan views of a reservoir unit 3. FIG. 4 is a perspective view of a part of a passage component 11 that is included in the reservoir unit 3, as seen at an angle from below. FIG. 5 is a perspective view of a part of the passage component 11, as seen at an angle from above. In FIG. 2, for the purpose of explanatory convenience, the ink-jet head 1 is scaled up in its thickness direction. Besides, an ink passage formed in the reservoir unit 3 is illustrated, although it actually does not appear on a section that is taken along an identical line. Among the views of FIG. 3, the uppermost one is the passage component 11 as seen from above, and the second uppermost one is the passage component 11 as seen from below. In FIGS. 3 to 5, films 41, 42, 49, and a filter plate 54 which will be described later are omitted for the purpose of easy understanding of a structure of the passage component 11.

The reservoir unit 3 temporarily stores ink therein, and supplies ink to a passage unit 9 which is included in the head main body 2. As shown in FIG. 3, the reservoir unit 3 has a layered structure in which the passage component 11 and three plates 12 to 14 are layered. The passage component 11 is elongated in the main scanning direction. Each of the three plates 12 to 14 has a rectangular plane elongated in the main scanning direction. The passage component 11 is made of a synthetic resin such as a polyethylene terephthalate resin, a polypropylene resin and the like. The three plates 12 to 14 are metal plates made of, e.g., SUS430.

As shown in FIGS. 2 and 3, from a surface 11*a* of the uppermost passage component 11, cylindrical joints 31 and 32 protrude in the vicinity of one longitudinal end and the other longitudinal end of the passage component 11, respectively. The joint 31 and the joint 32 are fitted into and thus connected to an ink supply tube (not shown) and an ink discharge tube (not shown), respectively.

As shown in FIGS. 3 and 4, annular walls 37 and 38 protrude from a back face 11*b* of the passage component 11. The annular walls 37 and 38 enclose regions that correspond to the joints 31 and 32, respectively. Both of the annular walls 37 and 38 are opened toward the plate 12. In a plan view, the annular wall 37 curves into an L-shape, from a point corresponding to the joint 31. In a plan view, the annular wall 38 curves into an L-shape, from a point corresponding to the joint 32. A space in the annular wall 38 with respect to a sub scanning direction is increased from the point corresponding to the joint 32, and reduced in the vicinity of a center of the passage component 11. As shown in FIG. 4, a protruding end 37*a* of the annular wall 37 has a tapered shape. The end 37*a* of the annular wall 37 is heated and melted through a film 41, so that the annular wall 37 is adhered to the film 41 (see FIG. 2). In the second uppermost view of FIG. 3, a left-side hatched region is a region adhered to the film 41. An opening of the annular wall 37 is thereby sealed, thus forming a space enclosed with the back face 11*b*, the annular wall 37, and the film 41. That is, a flow-in passage 45 communicating with the joint 31 and a later-described hole 46 is formed.

The end 37*a* of the annular wall 37 has a tapered shape, and therefore is easily melted when heated. Accordingly, by heating the end 37*a* of the annular wall 37 through the film 41, the film 41 can easily be adhered to the annular wall 37 while preventing a portion of the annular wall 37 except the end 37*a* from being melted. Even if the end 37*a* has an inaccurate flatness, inaccuracy can be compensated because the end 37*a* is melted down.

Like the end 37*a* of the annular wall 37, a protruding end of the annular wall 38 has a tapered shape. In the same manner as described above, the protruding end is melted so that the annular wall 38 is adhered to the film 42 (see FIG. 2). In the second uppermost view of FIG. 3, a right-side hatched region is a region adhered to the film 42. An opening of the annular wall 38 is thereby sealed. Thus, in a space enclosed with the back face 11*b*, the annular wall 38, and the film 42, a discharge passage 44 communicating with the joint 32 and a later-described hole 47 is formed.

As shown in FIG. 2 and in the uppermost and the second uppermost views of FIG. 3, circular holes 46 and 47 are formed on the surface 11*a* of the passage component 11 and penetrate to the back face 11*b*. The hole 46 is positioned so as to communicate with a downstream end of the flow-in passage 45. The hole 47 is formed at a position that is a little closer to the joint 32 than the center of the passage component 11 is. The hole 47 is positioned so as to communicate with an upstream end of the discharge passage 44.

As shown in the uppermost view of FIG. 3 and FIG. 5, an annular wall 48 that encloses the hole 46 and the hole 47 protrudes from the surface 11*a*. In a plan view, a space in the annular wall 48 with respect to the sub scanning direction is increased along a longitudinal direction of the passage component 11 from a vicinity of the hole 46 to a vicinity of both sides of the passage component 11, and then the annular wall 48 extends along the both sides to a vicinity of the center, and then the space is reduced toward the hole 47. As shown in FIG. 5, a protruding end 48*a* of the annular wall 48 has a tapered shape. The end 48*a* of the annular wall 48 is heated and melted through a film 49, so that the annular wall 48 is adhered to the film 49 (see FIG. 2). The uppermost view of FIG. 3 shows two annular hatched regions, the external one of which is a region that is adhered to the film 49. The film 49 has flexibility, and its upper face is touched by the atmosphere. The film 49 also works as a damper for damping vibration of ink. An opening of the annular wall 48 is thereby sealed, thus forming a space enclosed with the surface 11*a*, the annular wall 48, and the film 49. That is, a filter chamber 55 provided therein with a later-described filter plate 54 is formed.

The end 48*a* of the annular wall 48 has a tapered shape, and therefore is easily melted when heated. Accordingly, by heating the end 48*a* of the annular wall 48 through the film 49, the film 49 can easily be adhered to the annular wall 48 while preventing a portion of the annular wall 48 except the end 48*a* from being melted. Even if the end 48*a* has an inaccurate flatness, inaccuracy can be compensated because the end 48*a* is melted down.

The films 41, 42, and 49 are made of a material having excellent gas barrier properties such as a PET (polyethylene terephthalate) film on which a silica film (SiOx film), an aluminum film, or the like is vapor-deposited. Thus, gas outside the ink-jet head 1 can hardly enter an ink passage of the passage component 11 through the film 41, 42, and 49.

A region of the surface 11*a* inside the annular wall 48, which is sealed with the film 49, has a concavity 51. As shown in the uppermost view of FIG. 3, the concavity 51 extends from a vicinity of the hole 46 to a vicinity of the center of the passage component 11. In a plan view, a shape of the concavity 51 is similar to but slightly smaller than that of the annular wall 48. A circular hole 52 is formed on a bottom face of the concavity 51 and in the vicinity of the center of the passage component 11.

An annular face 53 is formed around the concavity 51. The annular face 53 extends annularly so as to enclose the concavity 51. A filter plate 54 (see FIG. 2) having many small-diameter holes for ink passing therethrough is fixed on the annular face 53. The filter plate 54 is made of nickel manufactured through an electroforming process for example. A peripheral edge of the filter plate 54 is fixed onto the annular face 53. The uppermost view of FIG. 3 shows two annular hatched regions, the internal one of which is the annular face 53 to which the filter plate 54 is fixed. An annular wall 58 is formed at a peripheral edge of the annular face 53. That is, the annular face 53 is partitioned by the annular wall 58 that is protrudingly provided along the outer edge of the filter plate 54. The annular wall 58 is lower than the annular wall 48. The annular wall 48 defines the filter chamber 55, and the annular wall 58 defines a supporter of the filter plate 54 which means the annular face 53.

As shown in FIG. 2, a curved passage 60 is formed in the passage component 11. The curved passage 60 extends from the hole 46 to the hole 52 through the filter chamber 55 and a space formed within the concavity 51 below the filter plate 54. The curved passage 60 is connected also to the discharge passage 44 via the hole 47. On a lower face of the passage component 11, an annular groove 67 is formed around the hole 52, so as to open downward. An O ring 68 is fitted in the annular groove 67.

As shown in FIG. 3, the passage component 11 has four holes 59 passing therethrough from the surface 11*a* to the back face 11*b*. Two of the holes 59 locate in a middle portion of the passage component 11 and two of them locate at both end portions of the passage component 11, with respect to the longitudinal direction of the passage component 11. The holes 59 are arranged point-symmetrically with respect to the center of the passage component 11.

As shown in FIGS. 2 and 3, circular holes 71 and 72 are formed at both longitudinal end portions of the plate 12 which is disposed just under the passage component 11. The holes 71 and 72 are used for fixing the ink-jet head 1 to a printer main body by use of screws or the like. The plate 12 has a circular hole 73 at its center, and positioning holes 75*a* and 75*b* at its portion that is a little closer to the center than the holes 71 and 72 are. The plate 12 further has four screw holes 76. Two of the screw holes 76 locate in a middle portion of the plate 12 and two of them locate at both end portions of the plate 12, with respect to the longitudinal direction of the plate 12. The screw holes 76 are arranged point-symmetrically with respect to the center of the plate 12. The screw holes 76 correspond to the above-described holes 59, respectively. By putting screws into the respective holes 59 and further screwing them into the screw holes 76 of the plate 12, the passage component 11 and the plate 12 are fixed to each other. At this time, the hole 52 of the passage component 11 and the hole 73 of the plate 12 are opposed to each other so that the curved passage 60 of the passage component 11 communicates with the hole 73. Since the O ring 68 is fitted in the annular groove 67, ink does not leak out at an outlet of the curved passage 60 into between the passage component 11 and the plate 12.

As shown in FIGS. 2 and 3, a plate 3 which is disposed immediately under the plate 12, has a through hole 81. The through hole 81 constitutes a reservoir passage 85 that includes a main passage 82 and ten branch passages 83 communicating with the main passage 82. In a plan view, the reservoir passage 85 is point-symmetrical with respect to a center of the plate 13. The main passage 82 extends along a longitudinal direction of the plate 13. Substantially a center of the main passage 82 corresponds to the hole 73 of the plate 12. A passage width of the branch passage 83 is smaller than a passage width of the main passage 82. All of the branch passages 83 have the same passage width, the same passage length, and substantially the same passage resistance. The plate 13 further has positioning holes 86*a* and 86*b* that correspond to the positioning holes 75*a* and 75*b* of the plate 12, respectively, and positioning holes 87*a* and 87*b* that are for positioning the plate 13 with a plate 14.

As shown in FIGS. 2 and 3, the lowermost plate 14 of the reservoir unit 3 has ink discharge holes 88 each having an elliptical shape. The ink discharge holes 88 are formed at positions corresponding to ends of the respective branch passages 83. The plate 14 further has four positioning holes 91*a*, 91*b*, 92*a*, and 92*b* corresponding to the positioning holes 86*a*, 86*b*, 87*a*, and 87*b* of the plate 13, respectively.

On a lower face of the plate 14, portions hatched in FIG. 3 protrude downward, to form protrusions 89*a*, 89*b*, 89*c*, and 89*d*. Each of the protrusions 89*a*, 89*b*, 89*c*, and 89*d* covers two or three ink discharge holes 88. The protrusions 89*a*, 89*b*, 89*c*, and 89*d* are formed by etching when the ink discharge holes 88 are formed.

The protrusions 89*a* and 89*d* locate at both longitudinal ends of the plate 14, respectively. Each of the protrusions 89*a* and 89*d* covers three ink discharge holes 88. Each of the protrusions 89*b* and 89*c* covers two ink discharge holes 88. The protrusions 89*a* and 89*d* have the same shape in a plan view. The protrusions 89*b* and 89*c* have the same shape in a plan view. The protrusions 89*a* to 89*d* are arranged point-symmetrically with respect to a center of the plate 14.

Figure 6:
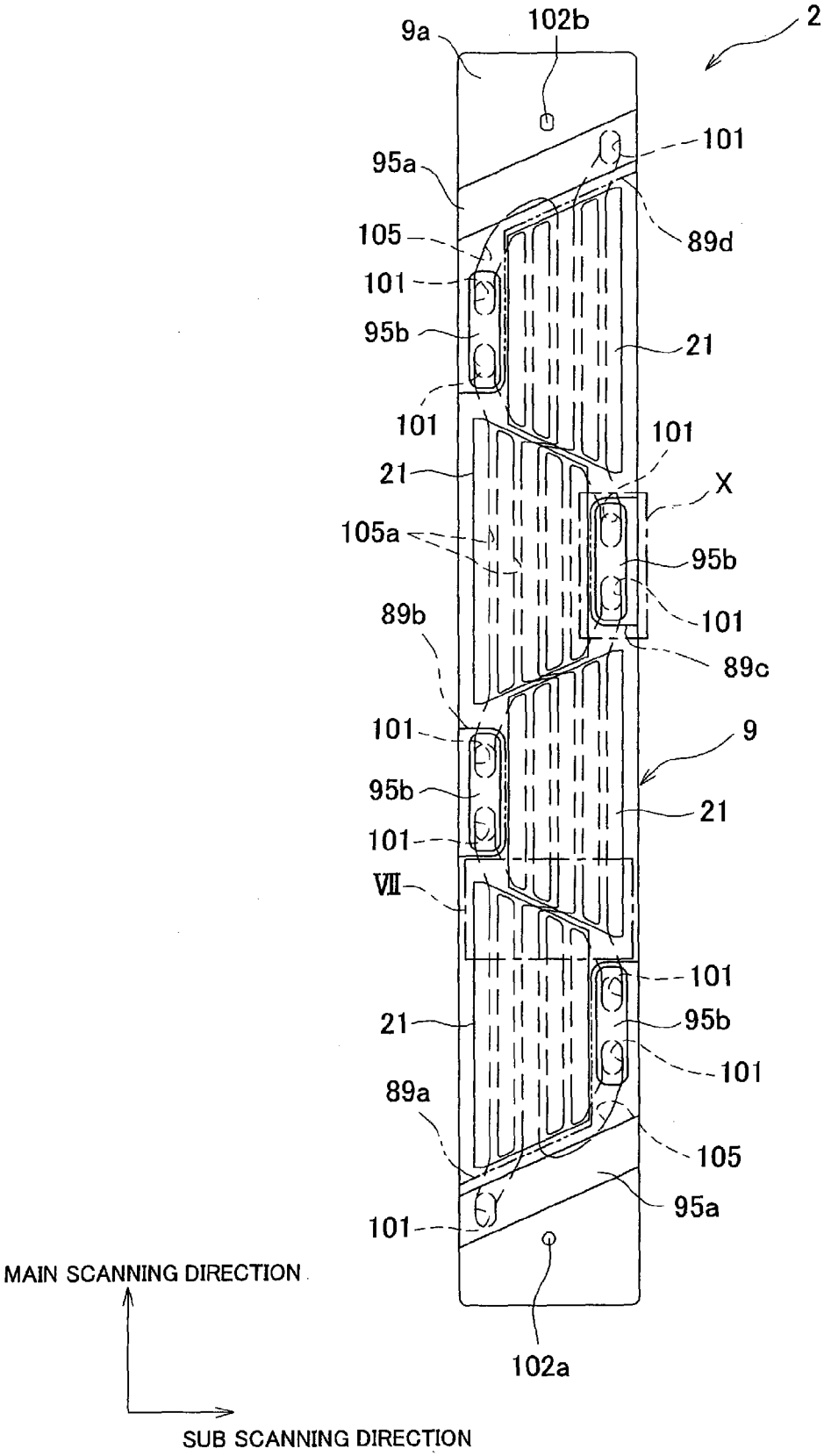
FIG. 6 is a plan view of a head main body that is included in the ink-jet head.
Figure 10A:
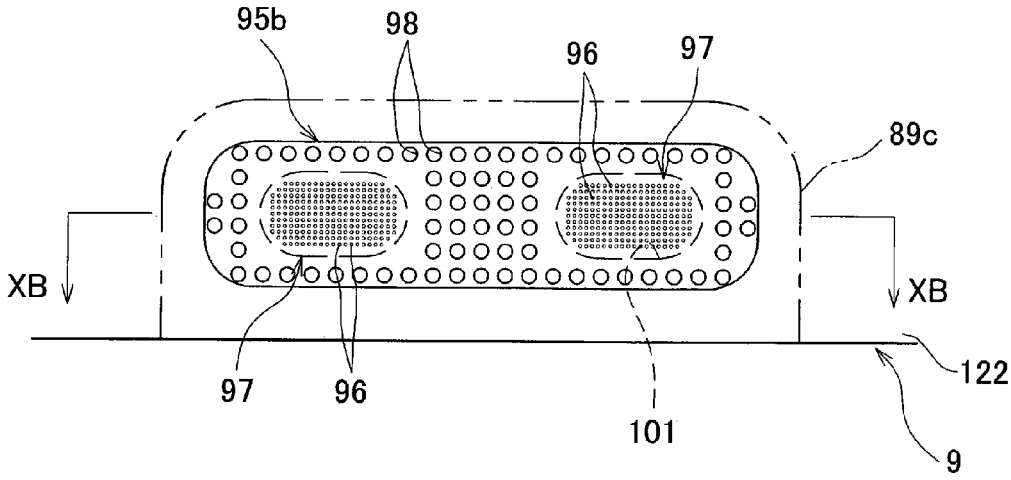
FIG. 10A is an enlarged view of a region X which is, in FIG. 6, enclosed with an alternate long and short dash line.
Figure 10B:
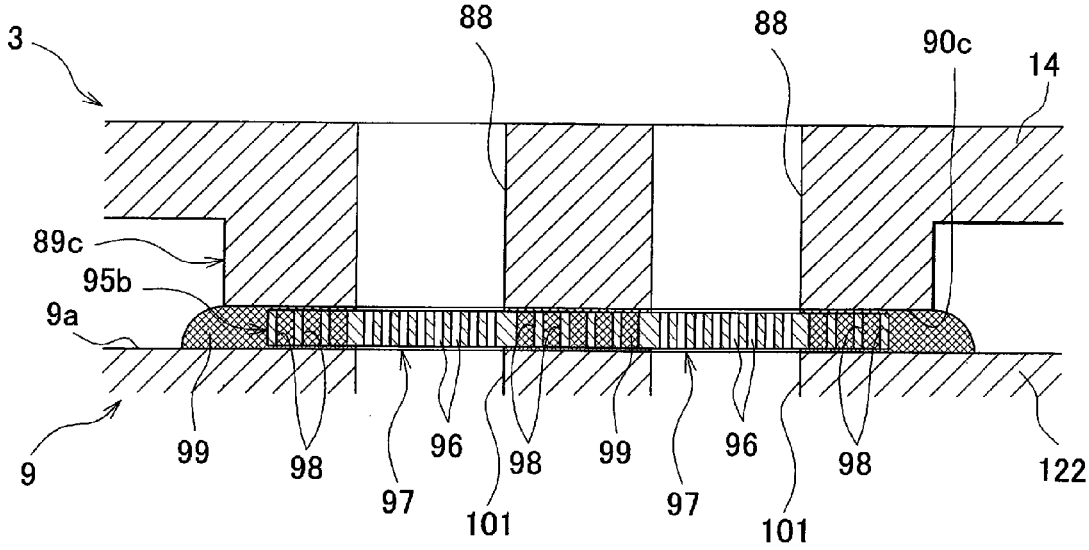
FIG. 10B is a local sectional view as taken along a line XB-XB of FIG. 10A.

End faces 90*a*, 90*b*, 90*c*, and 90*d* of the respective protrusions 89*a* to 89*d* are fixed to an upper face 9*a* of the passage unit 9 via filter plates 95*a* or 95*b* (see FIG. 6, FIG. 10A, and FIG. 10B). In the plate 14, a portion other than the protrusions 89*a* to 89*d* is spaced apart from the passage unit 9, so that a spaced is formed. The FPCs 6 extends through the space.

By positioning pins (not shown) being inserted into the positioning holes 75*a*, 75*b*, 86*a*, 86*b*, 87*a*, 87*b*, 91*a*, 91*b*, 92*a*, and 92*b*, the three plates 12 to 14 are positioned with one another, and fixed by an adhesive. Thus, the reservoir unit 3 having the passage component 11 and the three plates 12 to 14 layered on one another is formed.

Next, a description will be given to how ink flows within the reservoir unit 3. Within the reservoir unit 3, the flow-in passage 45, the curved passage 60, the filter chamber 55, and the reservoir passage 85 are formed. Ink is temporarily stored in the reservoir unit 3.

As indicated by black arrows of FIG. 2, ink that has flown through the joint 31 into the passage component 11 flows horizontally through the flow-in passage 45, and then flows upward through the hole 46, and then flows into the curved passage 60. In a case where the joint 32 is opened, some of the ink that has flown into the curved passage 60 flows through the hole 47 into the discharge passage 44 and then into the joint 32. At an initial stage of introducing ink for example, by discharging ink from the joint 32, air existing on an upper face of the filter plate 54 is also discharged together with the ink, so that fresh ink is charged on an upstream side of the filter plate 54.

The ink that has flown into the filter chamber 55 passes through the holes 54*a* of the filter plate 54, and falls into the concavity 51. The ink that has fallen into the concavity 51 passes through the holes 52 and 73, and falls into the reservoir passage 85. Then, the ink flows from the center of the main passage 82 toward both longitudinal ends of the main passage 82, as indicated by arrows in the fourth view from the top of FIG. 3. The ink reaches the both longitudinal ends of the main passage 82, and flows into the respective branch passages 83. The ink that has flown into the respective branch passages 83 passes through the ink discharge holes 88 and the holes 96 (see FIG. 6, FIG. 10A, and FIG. 10B) of the filter plates 95*a* and 95*b*, and then flows through ink supply ports 101 into the passage unit 9.

The ink that has flown into the passage unit 9 is, as will be described later, distributed to many individual ink passages 132 (see FIG. 8) that communicate with manifold channels 105. The ink then reaches nozzles 108 which are terminals of the respective individual ink passages 132, and then ejected to outside.

Figure 7:
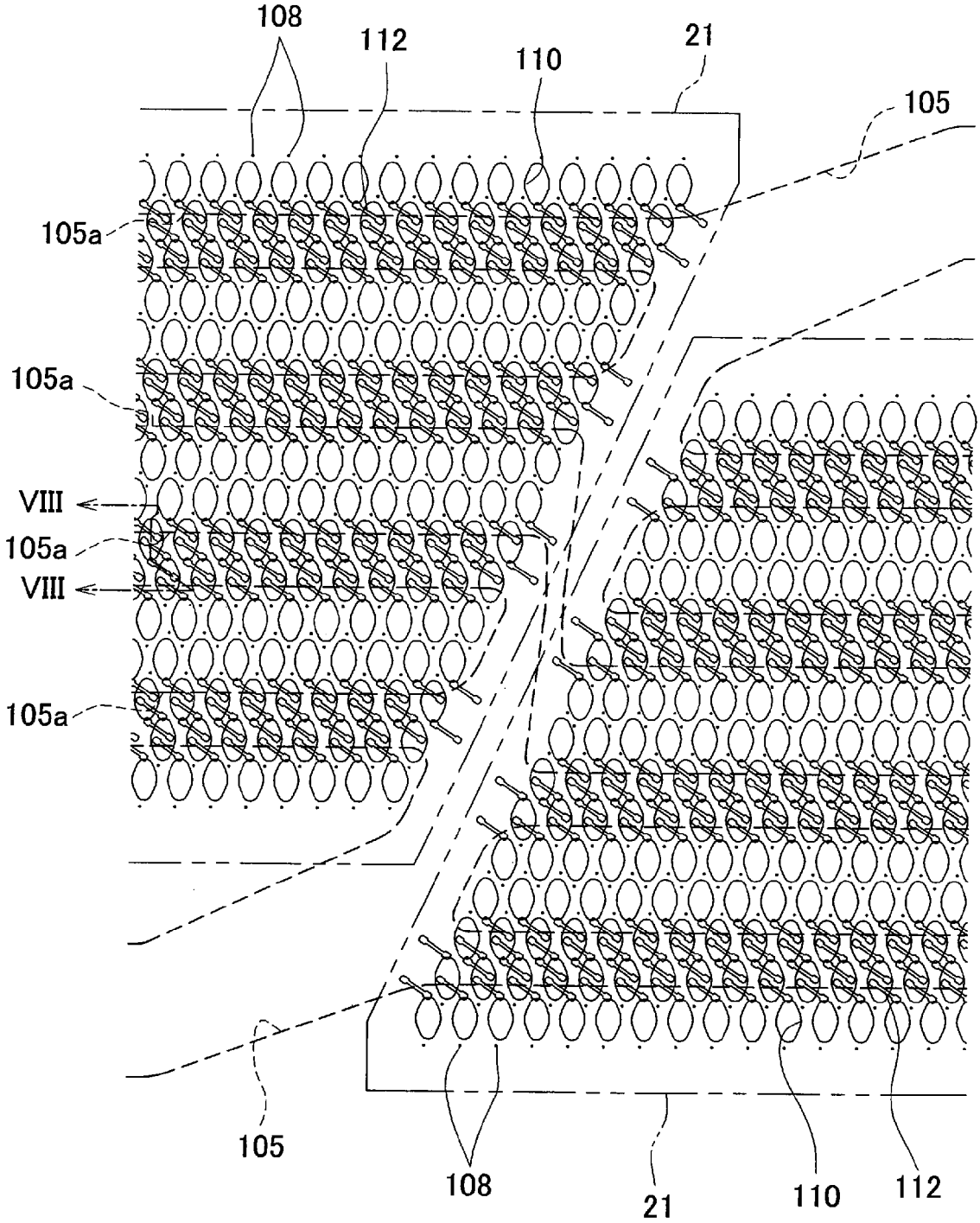
FIG. 7 is an enlarged view of a region VII of FIG. 6 which is enclosed with an alternate long and short dash line.
Figure 8:
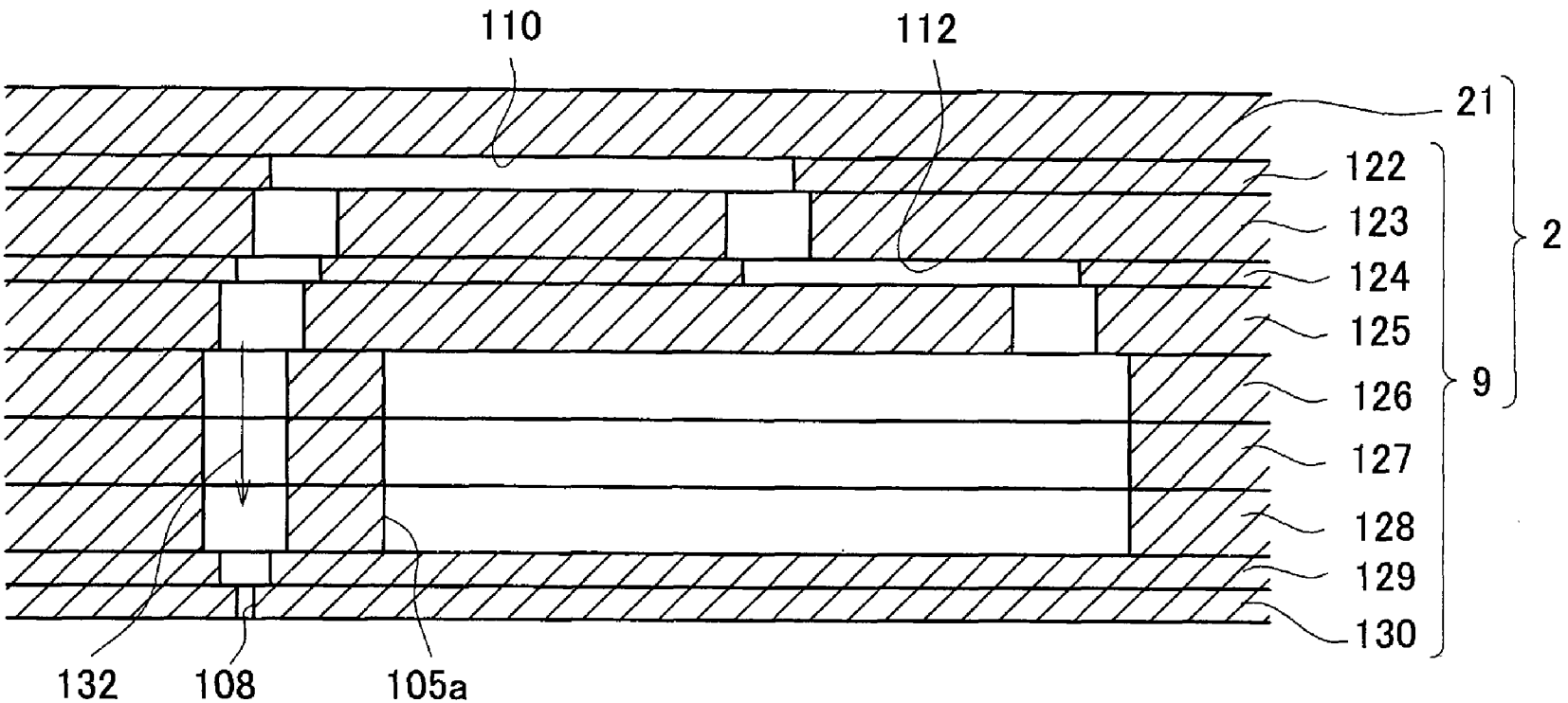
FIG. 8 is a local sectional view as taken along a line VIII-VIII of FIG. 7.
Figure 9A:
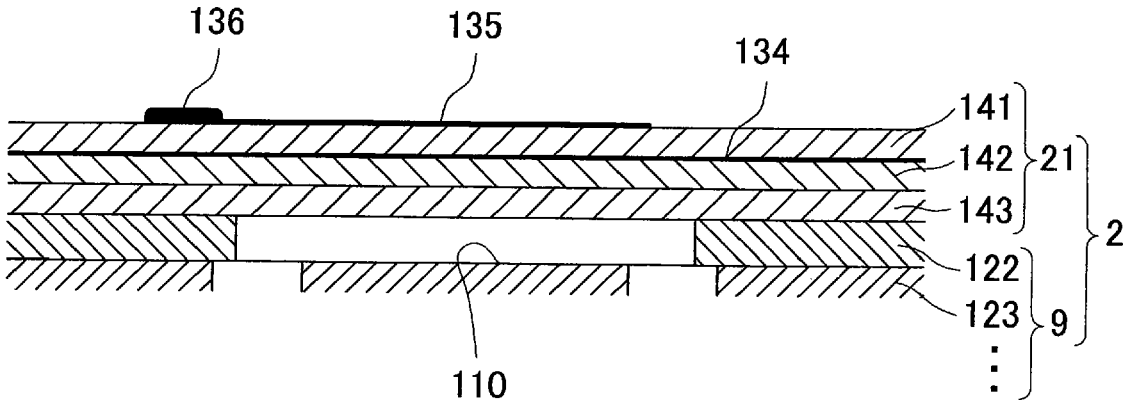
FIG. 9A is an enlarged sectional view of an actuator unit.
Figure 9B:
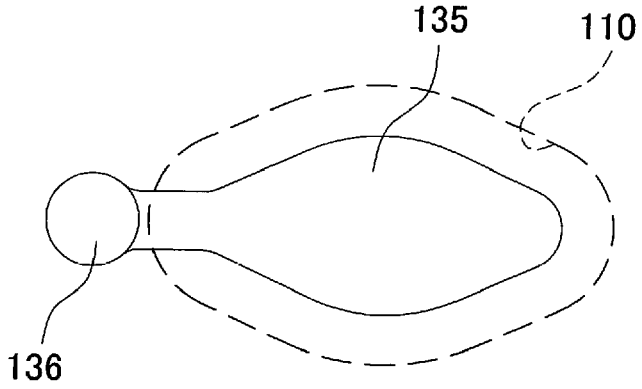
FIG. 9B is a plan view of an individual electrode that is disposed on a surface of the actuator unit.

Next, the head main body 2 will be described with reference to FIG. 9 to FIGS. 9A and 9B. FIG. 6 is a plan view of the head main body 2. FIG. 7 is an enlarged view of a region VII which is, in FIG. 6, enclosed with an alternate long and short dash line. In FIG. 7, for the purpose of explanatory convenience, pressure chambers 110, apertures 112, and nozzles 108 are illustrated with solid lines although they locate below the actuator units 21 and therefore should actually be illustrated with broken lines. FIG. 8 is a local sectional view as taken along a line VIII-VIII of FIG. 7. FIG. 9A is an enlarged sectional view of an actuator unit 21. FIG. 9B is a plan view of an individual electrode that is disposed on a surface of the actuator unit 21.

As shown in FIG. 6, the head main body 2 includes the passage unit 9 and four actuator units 21 that are fixed on the upper face 9*a* of the passage unit 9. The actuator unit 21 includes actuators each corresponding to each pressure chamber 110, and has a function of selectively applying ejection energy to ink contained within the pressure chambers 110 that are formed on the passage unit 9.

An outer shape of the passage unit 9 is a substantially rectangular parallelepiped shape having substantially the same width as that of the reservoir unit 3 and a slightly smaller length with respect to the main scanning direction as that of the reservoir unit 3. As shown in FIGS. 7 and 8, a lower face of the passage unit 9 is an ink ejection face in which many nozzles 108 are arranged in a matrix. Portions of the ink ejection face which correspond to portions where the actuator units 21 are bonded are ink ejection regions. On the upper face of the passage unit 9, many pressure chambers 110 are formed in a matrix like the nozzles 108. Formed within the passage unit 9 are many individual ink passages 132 each corresponding to each pressure chamber 110 and each nozzle 108.

Positioning holes 102*a* and 102*b* corresponding to the positioning holes 87*a*, 87*b*, 92*a*, and 92*b* of the plates 13 and 14 are formed at both longitudinal ends of the passage unit 9. By putting positioning pins through the positioning holes 87*a*, 87*b*, 92*a*, 92*b*, 102*a* and 102*b*, the passage unit 9 and the reservoir unit 3 are positioned with each other.

As shown in FIG. 8, the passage unit 9 has nine plates of, from the top, a cavity plate 122, a base plate 123, an aperture plate 124, a supply plate 125, manifold plates 126, 127, 128, a cover plate 129, and a nozzle plate 130. Each of the plates 122 to 130 is, like the plates 12 to 14 of the reservoir unit 3, made of SUS430 for example and, in a plan view, has a rectangular shape elongated in the main scanning direction (see FIG. 1).

Formed in the cavity plate 122 are through holes serving as the ink supply ports 101 (see FIG. 6) and many substantially rhombic through holes serving as the pressure chambers 110. Formed in the base plate 123 are communication holes each provided for each pressure chamber 110 so as to connect a pressure chamber 110 to an aperture 112, and communication holes each provided for each pressure chamber 110 so as to connect a pressure chamber 110 to a nozzle 108. Also formed in the base plate 123 are communication holes each connecting an ink supply port 101 to a manifold channel 105. Formed in the aperture plate 124 are through holes each provided for each pressure chamber 110 and serving as an aperture 112, and communication holes each provided for each pressure chamber so as to connect a pressure chamber 110 to a nozzle 108. Also formed in the aperture plate 124 are communication holes each connecting an ink supply port 101 to a manifold channel 105. Formed in the supply plate 125 are communication holes each provided for each pressure chamber 110 so as to connect an aperture 112 to a sub manifold channel 105*a*, and communication holes each provided for each pressure chamber 110 so as to connect each pressure chamber 110 to a nozzle 108. Also formed in the supply plate 125 are communication holes each connecting an ink supply port 101 to a manifold channel 105. Formed in the manifold plates 126, 127, and 128 are communication holes each provided for each pressure chamber 110 so as to connect a pressure chamber 110 to a nozzle 108. Also formed in the manifold plates 126, 127, and 128 are through holes that cooperate with each other to constitute manifold channels 105 or sub manifold channels 105*a* when the plates are put in layers. Formed in the cover plate 129 are communication holes each provided for each pressure chamber 110 so as to connect a pressure chamber 110 to a nozzle 108. Formed in the nozzle plate 130 are through holes each provided for each pressure chamber 110 and serving as each nozzle 108.

The nine plates 122 to 130 are positioned, put in layers, and fixed to one another so that an individual ink passage 132 as shown in FIG. 8 is formed inside the passage unit 9.

Referring to FIG. 6 again, a total of ten ink supply ports 101 are opened on the upper face 9*a* of the passage unit 9. The ten ink supply ports 101 correspond to the ink discharge holes 88 of the reservoir unit 3 (see the lowermost view of FIG. 3). Manifold channels 105 that communicate with the ink supply ports 101, and sub manifold channels 105*a* that branch from the manifold channels 105 are formed within the passage unit 9. Individual ink passages 132 are provided for the respective nozzles 108. As shown in FIG. 8, each of the individual ink passages 132 extends from a manifold channel 105 to a nozzle 108 through a sub manifold channel 105*a*, an outlet of the sub manifold channel 105*a*, an aperture 112, and a pressure chamber 110. Ink is supplied from the reservoir unit 3 through the ink supply ports 101 into the passage unit 9, and then branches from the manifold channels 105 into the sub manifold channels 105*a*, and then goes through the apertures 112 which function as throttle and the pressure chambers 110 to the nozzles 108.

The filter plates 95*a* and 95*b* that cover the ink supply ports 101 are disposed on the upper face 9*a* of the passage unit 9. Each of the two filter plates 95*a* extends obliquely with respect to a widthwise direction of the passage unit 9, so as to cover the ink supply ports 101 that locate at each longitudinal end portion of the passage unit 9. Each of the four filter plates 95*b* has a shape elongated in a longitudinal direction of the passage unit 9. The ink supply ports 101 that are paired and arranged in a zigzag pattern along the longitudinal direction of the passage unit 9. The four filter plates 95*b* are disposed so as each of them covers two of the ink supply ports 101. The filter plates 95*a* and 95*b* are disposed in regions to which the protrusions 89*a* to 89*d* (as illustrated with alternate long and two short dashes lines in FIG. 6) of the plate 14 of the reservoir unit 3 are fixed. The filter plates 95*a* and 95*b* are made of nickel metal that has been manufactured through a known electroforming process for example, and a thickness of the filter plates 95*a* and 95*b* is equal to or less than 8 μm.

As shown in FIG. 6, the four actuator units 21 each having a trapezoidal shape in a plan view are arranged in a zigzag pattern so as to keep out from the ink supply ports 101 and the filter plates 95*a*, 95*b*. Parallel opposed sides of each actuator unit 21 extend along the longitudinal direction of the passage unit 9. Oblique sides of every neighboring actuator units 21 overlap each other with respect to the widthwise direction of the passage unit 9. Neighboring actuator units 21 locate equidistantly on opposite sides of a widthwise center of the passage unit 9.

As described above, the reservoir unit 3 is fixed to the passage unit 9 with the protrusions 89*a* to 89*d* therebetween. The portion of the lower face of the reservoir unit 3 other than the protrusions 89*a* to 89*d* (which is not hatched in the lowermost view of FIG. 3) is spaced apart from the passage unit 9 at an interval corresponding to a protruding height of the protrusions 89*a* to 89*d*. The actuator units 21 are fixed to portions of the upper face 9*a* of the passage unit 9 which are spaced apart from and opposed to the lower face of the reservoir unit 3. The FPCs 6 fixed on the actuator units 21 are not in contact with the lower face of the reservoir unit 3.

As shown in FIG. 9A, the actuator unit 21 includes three piezoelectric sheets 141, 142, and 143 each having a thickness of approximately 15 μm and made of, for example, a lead zirconate titanate (PZT)-base ceramic material with ferroelectricity. The piezoelectric sheets 141 to 143 are disposed so as to extend over many pressure chambers 110 that correspond to one ink ejection face.

On the uppermost piezoelectric sheet 141, individual electrodes 135 are formed at positions corresponding to the respective pressure chambers 110. A common electrode 134 having a thickness of approximately 2 μm is interposed between the uppermost piezoelectric sheet 141 and the piezoelectric sheet 142 disposed under the uppermost piezoelectric sheet 141. The common electrode 134 is formed over entire surfaces of the sheets. Both of the individual electrodes 135 and the common electrode 134 are made of an Ag—Pd-base metallic material for example. No electrode is disposed between the piezoelectric sheets 142 and 143.

The individual electrode 135 has a thickness of approximately 1 μm. In a plan view, as shown in FIG. 9B, the individual electrode 135 has a substantially rhombic shape similar to that of the pressure chamber 110. One acute portion of the individual electrode 135 extends out. Formed at an end of the acute portion is a circular land 136 having a diameter of approximately 160 μm and electrically connected to the individual electrode 135. The land 136 is made of gold including glass frits, for example. As shown in FIG. 9A, the land 136 is, at a predetermined position on an extending-out portion of the individual electrode 135, electrically bonded to a contact that is provided on the FPC 6 (see FIG. 1). The position is, with respect to a thickness direction of the piezoelectric sheets 141 to 143, opposed to a wall of the cavity plate 122 defining the pressure chambers 110. That is, the position does not overlap the pressure chamber 110 with respect to the thickness direction of the piezoelectric sheets 141 to 143.

In a region not illustrated, the common electrode 134 is grounded. Thus, the common electrode 134 is, at its portions corresponding to all the pressure chambers 110, equally kept at the ground potential. In order that potentials of the respective individual electrodes 135 can selectively be controlled, the FPC 6 through which the individual electrodes 135 are connected to the driver IC 7 (see FIG. 1) includes lead wires that are provided for the respective individual electrodes 135 independently of one another. That is, a portion of the actuator unit 21 sandwiched between each individual electrode 135 and the pressure chamber 110 works as an individual actuator. The number of actuators included in the actuator unit 21 equals the number of pressure chambers 110.

Here, a driving mode of the actuator unit 21 will be described. The piezoelectric sheet 141 is polarized in its thickness direction. When the individual electrode 135 is set at a potential different from a potential of the common electrode 134, an electric field in a polarization direction is applied to the piezoelectric sheet 141. As a result, a portion of the piezoelectric sheet 141 to which the electric field is applied acts as an active portion which is distorted by a piezoelectric effect. That is, the piezoelectric sheet 141 extends or contracts in its thickness direction, and contracts or extends in a plane direction by a transversal piezoelectric effect. The other two piezoelectric sheets 142 and 143 form inactive layers not including a region sandwiched between the individual electrode 135 and the common electrode 134, and therefore cannot deform by themselves. That is, the actuator unit 21 is of so-called unimorph type, in which upper one piezoelectric sheet 141 distant from the pressure chambers 110 is a layer including active portions and the lower two piezoelectric sheet 142 and 143 closer to the pressure chambers 110 are layers including no active portions.

As shown in FIG. 9A, the piezoelectric sheets 141 to 143 are fixed on an upper face of the cavity plate 122 that partitions the pressure chambers 110. When difference occurs between plane-direction distortion of a portion of the piezoelectric sheet 141 to which the electric field is applied and plane-direction distortion of the lower piezoelectric sheets 142 and 143, the piezoelectric sheets 141 to 143 as a whole are deformed to protrude toward the pressure chamber 110 (unimorph deformation). This reduces the volume of the pressure chamber 110. Pressure inside the pressure chamber 110 rises accordingly, and ink is pushed out of the pressure chamber 110 to the nozzle 108 and then ejected from the nozzle 108. Thereafter, when the individual electrode 135 is set at the same potential as the potential of the common electrode 134, the piezoelectric sheets 141 to 143 restore the original flat shape, and the volume of the pressure chamber 110 is also returned to the original one. Ink is accordingly introduced from the manifold channel 105 into the pressure chamber 110, and thus the pressure chamber 110 is charged with ink again.

Next, a layered structure of the head main body 2 and the reservoir unit 3 will be described. The head main body 2 and the reservoir unit 3 are fixed to each other as follows. That is, the plate 14 which forms the lowermost layer of the reservoir unit 3 and the cavity plate 122 which forms the uppermost layer of the passage unit 9 are bonded by, for example, an epoxy-based adhesive 99 with the filter plates 95*a* and 95*b* being interposed between the plate 14 and the plate 122.

Here, with reference to FIGS. 10A and 10B, a detailed description will be given to a layered structure in a region X, which is enclosed with an alternate long and short dash line in FIG. 6. In the region X, the filter plate 95*b* is interposed in the layered structure. FIG. 10A is an enlarged view of the region X which is, in FIG. 6, enclosed with the alternate long and short dash line. FIG. 10B is a local sectional view as taken along a line XB-XB of FIG. 10A. In FIG. 10A, alternate long and two short dashes lines indicate outer shapes of the protrusions 89*c* of the plate 14. A description of a layered structure having the filter plate 95*a* interposed therein will be omitted, because the layered structure having the filter plate 95*a* interposed therein is the same as the layered structure having the filter plate 95*b* interposed therein which will be described below.

As shown in FIG. 10A, many through holes are formed substantially over a whole area of the filter plate 95*b*. The through holes include two types of holes, that is, holes 96 that are formed in regions opposed to the ink supply ports 101 and holes 98 that are formed in a region that surrounds the ink supply ports 101. The holes 96 aggregate to form a hole group 97 that constitutes a filter. Ink passes through the respective holes 96. The holes 98 are filled with the adhesive 99 that bonds the reservoir unit 3 and the passage unit 9.

A planar shape of the hole 98 is a circle having a diameter of approximately 100 μm. A planar shape of the hole 96 is a circle having a diameter of approximately 8 to 12 μm, which is smaller than the diameter of the hole 98. A diameter of the nozzle 108 is approximately 20 μm. A foreign substance having such a size that may clog the nozzle 108 is already removed from ink having passed through the holes 96. Each of the holes 98 locates away from the hole group 97 at an interval larger than an interval between neighboring holes 98.

As shown in FIG. 10B, the filter plate 95*b* is sandwiched between the end face 90*c* of the protrusion 89*c* and the upper face 9*a* of the cavity plate 122, which are planes parallel to each other. As shown in FIG. 10A, a size of the filter plate 95*b* is included in a size of the end face 90*c* in a plan view. The adhesive 99 is filled in the holes 98, and moreover applied so as to annularly surround the filter plate 95*b* and so as to contact an outer edge of the filter plate 95*b*. In this condition, pressure is applied to the reservoir unit 3 and the head main body 2 while heating the reservoir unit 3 and the head main body 2. Thereby, they are bonded by the adhesive 99. At this time, the plates 14 and 122 are bonded to each other by means of the adhesive 99 that is filled in the holes 98 and the adhesive 99 that is disposed around the filter plate 95*b* so as to contact the outer edge of the filter plate 95*b*. The filter plate 95*b* is fixed between the plates 14 and 122 while annularly surrounded by the adhesive 99.

As described above, in the ink-jet head 1 that adopts a layered structure according to this embodiment, the plate 14 of the reservoir unit 3 and the cavity plate 122 of the passage unit 9 are bonded to each other by means of the adhesive 99 that is disposed between the plates 14 and 122, the adhesive 99 not opposed to the filter plates 95*a* and 95*b*. That is, the plates 14 and 122 are bonded to each other by means of the adhesive 99 disposed around the filter plates 95*a* and 95*b* and the adhesive 99 filled in the holes 98 of the filter plates 95*a* and 95*b*. Accordingly, even if adhesion of the adhesive 99 to the filter plates 95*a* and 95*b* is small, the plates 14 and 122 are firmly bonded and thus not easily separated from each other. Thus, the head main unit 2 and the reservoir unit 3 are surely fixed.

In addition, since the adhesive 99 is provided so as to surround the filter plates 95*a* and 95*b*, the filter plates 95*a* and 95*b* do not fall out of between the plates 14 and 122. Moreover, ink passing through the hole groups 97 of the filter plates 95*a* and 95*b* does not leak to outside.

Since the adhesive 99 is in contact with the outer edges of the filter plates 95*a* and 95*b*, positions of the filter plates 95*a* and 95*b* can more surely be fixed.

The adhesive 99 is filled in the holes 98 as well. The plates 14 and 122 are bonded to each other not only by the adhesive 99 disposed around the filter plates 95*a* and 95*b* but also by the adhesive 99 filled in the holes 98. This enables the plates 14 and 122 to be bonded more firmly. Moreover, positions of the filter plates 95*a* and 95*b* are more surely fixed by means of the adhesive 99 filled in the holes 98.

The diameter of the hole 98 is larger than the diameter of the hole 96 of the hole group 97 that constitutes the filter. This makes it easy to fill the adhesive 99 into the holes 98. Thus, a sufficient amount of adhesive 99 can be filled into the holes 98, and therefore adhesion between the plates 14 and 122 can be ensured well.

Each of the holes 98 locates away from the hole group 97 at an interval larger than an interval between neighboring holes 98. As a result, even if the adhesive 99 filled in the holes 98 spreads out over an interface between the filter plates 95*a*, 95*b* and the reservoir unit 3 or between the filter plates 95*a*, 95*b* and the passage unit 9, the spread does not easily reach the hole group 97. This can prevent the adhesive 99 from closing the holes 96 and deteriorating a filter function.

Since the thickness of the filter plate 95*a*, 95*b* is equal to or less than 8 μm, the adhesive 99 disposed between the plates 14 and 122 also has a small thickness. Therefore, separation of the plates 14 and 122 can more surely be prevented.

Since the protrusions 89*a* to 89*d* are formed integral with the plate 14, it is not necessary to provide separate members as the protrusions 89*a* to 89*d*. Therefore, the reservoir unit 3 can easily be prepared.

Figure 11:
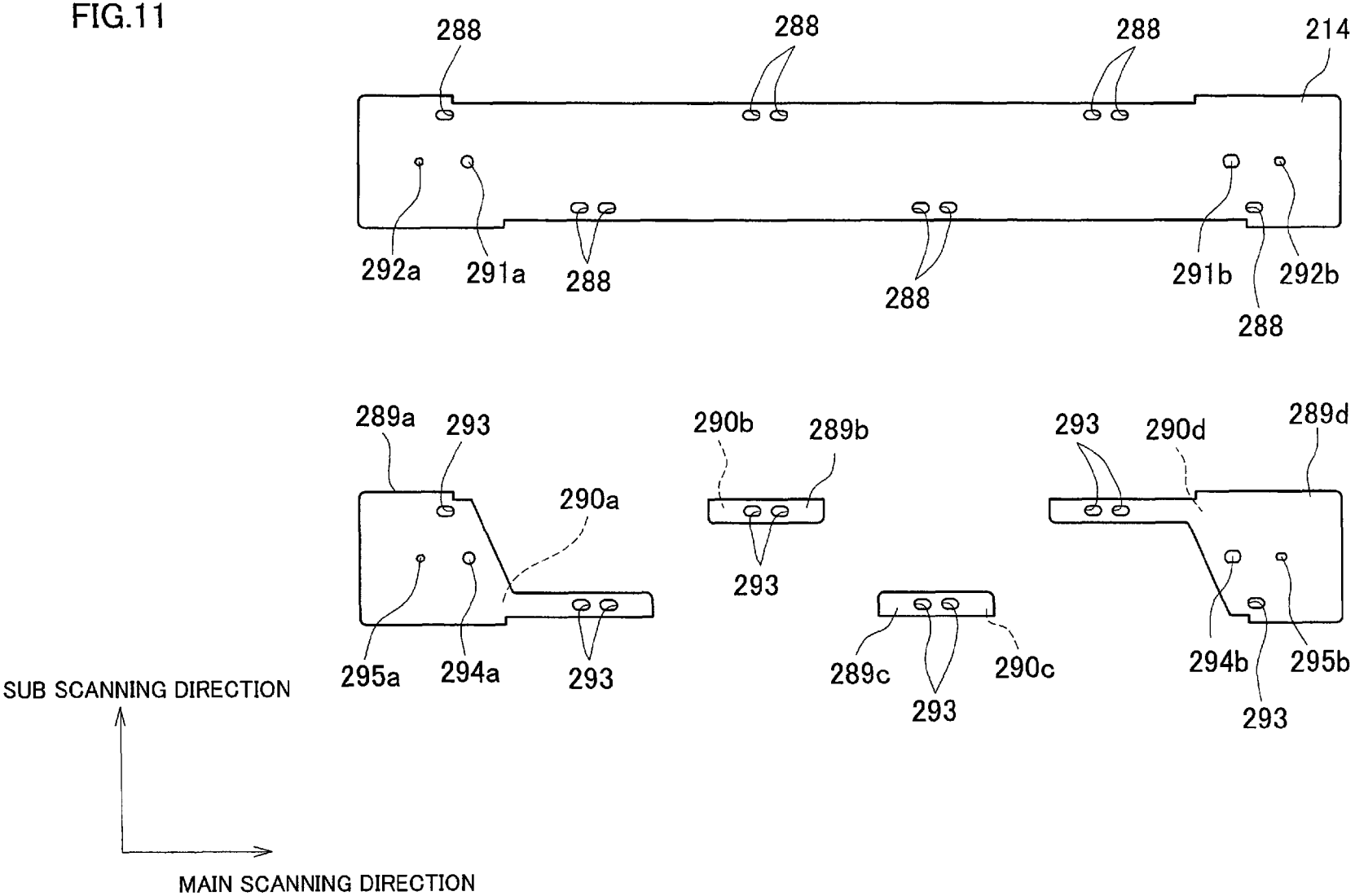
FIG. 11 is an exploded plan view showing a part of a reservoir unit according to a modification.

Next, with reference to FIG. 11, a modification of the reservoir unit will be described below. The same members as in the above-described embodiment will be denoted by the same reference numerals, without a specific description thereof.

A reservoir unit of this modification is the reservoir unit 3 of the above-described embodiment except that the plate 14 is replaced with a plate 214 and small pieces 289*a*, 289*b*, 289*c*, and 289*d*. That is, a reservoir unit of this modification has the passage component 11, the two plates 12, 13, the plate 214 bonded to a lower face of the plate 13, and the four small pieces 289*a* to 289*d* bonded to a lower face of the plate 214.

The plate 214 differs from the plate 14 only in that it does not have the protrusions 89*a* to 89*d* formed on the plate 14. In the plate 214, ink discharge holes 288 each having an elliptical shape are formed at positions corresponding to ends of the respective branch passages 83. The plate 214 further has four positioning holes 291*a*, 291*b*, 292*a*, and 292*b* corresponding to the positioning holes 86*a*, 86*b*, 87*a*, and 87*b* of the plate 13, respectively.

The small pieces 289*a* to 289*d* correspond to the above-described protrusions 89*a* to 89*d*, respectively. A planar shape of each of the small pieces 289*a* to 289*d* is the same as a planar shape of each of the protrusions 89*a* to 89*d*. The small pieces 289*a* to 289*d* are bonded to the same regions of the lower face of the plate 214 as the regions of the plate 14 in which the protrusions 89*a* to 89*d* are provided. Each of the small pieces 289*a* and 289*d* has three communication holes 293 that respectively communicate with the ink discharge holes 288. Each of the small pieces 289*b* and 289*c* has two communication holes 293 that respectively communicate with the ink discharge holes 288. The small pieces 289*a* and 289*d* have positioning holes 294*a*, 294*b*, 295*a*, and 295*b* that correspond to the positioning holes 291*a*, 291*b*, 292*a*, and 292*b* of the plate 214, respectively. That is, the small pieces 289*a* to 289*d* are equivalent to the protrusions 89*a* to 89*d* that have been separated from the plate 14.

A flat plate having a uniform thickness is subjected to a laser machining or an etching processing, so that the small pieces 289*a* to 289*d* are cut out from the flat plate. Thus, the small pieces 289*a* to 289*d* have the same thickness.

The small pieces 289*a* to 289*d* are bonded to the lower face of the plate 214, which is then bonded to a lower face of a sequentially-layered structure of the passage component 11, the plate 12, and the plate 13, that is, the lower face of the plate 13. The reservoir unit of this modification can thereby be obtained. End faces 290*a*, 290*b*, 290*c*, and 290*d* of the small pieces 289*a*, 289*b*, 289*c*, and 289*d*, that is, faces of the small pieces 289*a* to 289*d* opposite to their faces bonded to the plate 214, are fixed to the upper face 9*a* of the passage unit 9 with the filter plates 95*a* or 95*b* interposed therebetween.

Figure 12:
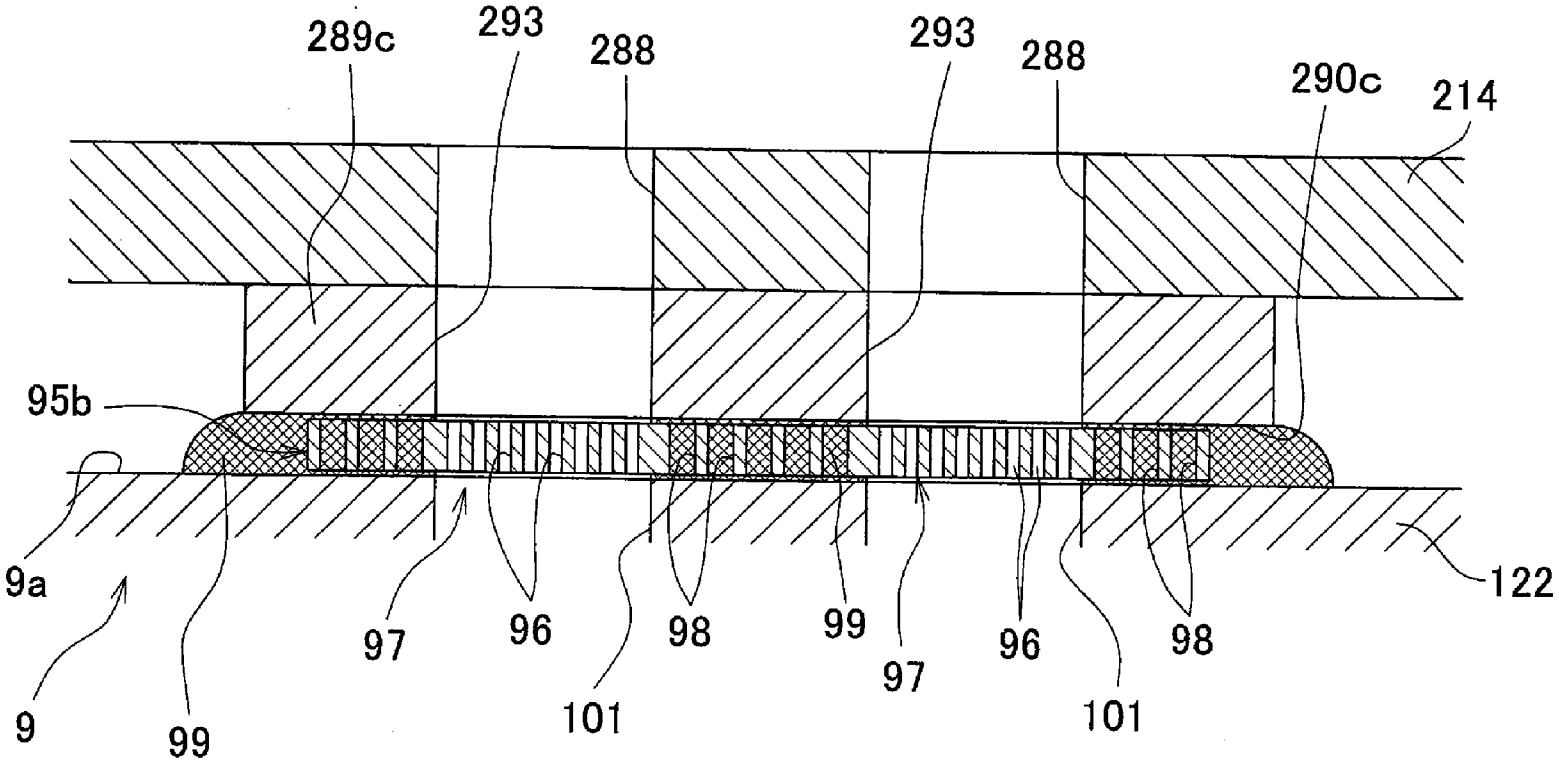
FIG. 12 is a local sectional view showing a layered structure according to the modification as shown in FIG. 11.

In the following, a layered structure of the reservoir unit of this modification and the head main body 2 will be described with reference to FIG. 12. FIG. 12 is a detailed view of a region in which the small piece 289*c* is disposed. A layered structure having the small piece 289*c* interposed therein will be described below, and a description of layered structures having the other small pieces 289*a*, 289*b*, and 289*d* interposed therein will be omitted because they are the same as the layered structure having the small piece 289*c* interposed therein.

As shown in FIG. 12, the cavity plate 122 and the small piece 289*c* which is bonded to the lower face of the plate 214 are bonded by the adhesive 99 with the filter plate 95*b* being interposed therebetween. Thereby, the cavity plate 122 and the small piece 289*c* are fixed to each other.

The filter plate 95*b* is sandwiched between the end face 290*c* of the small piece 289*c* and the upper face 9*a* of the cavity plate 122, which are planes parallel to each other. In a plan view, a size of the filter plate 95*b* is included in a size of the end face 290*c*. The adhesive 99 is filled in the holes 98, and moreover applied so as to annularly surround the filter plate 95*b* and so as to contact an outer edge of the filter plate 95*b*. In this condition, pressure is applied to the reservoir unit and the head main body 2 while heating the reservoir unit and the head main body 2. Thereby, they are bonded by the adhesive 99. At this time, the small piece 289*c* and the cavity plate 122 are bonded to each other by means of the adhesive 99 that is filled in the holes 98 and the adhesive 99 that is disposed around the filter plate 95*b* so as to contact the outer edge of the filter plate 95*b*. The filter plate 95*b* is fixed between the small piece 289*c* and the cavity plate 122 while annularly surrounded by the adhesive 99.

As described above, the layered structure according to this modification presents the same effect as in the above-described embodiment. In addition, in the above-described embodiment the protrusions 89*a* to 89*d* may have uneven heights because they are formed through an etching process, but in this modification the small pieces 289*a* to 289*d* are members separate from the plate 214 which forms the reservoir unit and therefore the problem can be reduced. To be more specific, since the small pieces 289*a* to 289*d* are cut out from the flat plate having a uniform thickness, the small pieces 289*a* to 289*d* have the same thickness, which allows a space formed between the plate 214 and the cavity plate 122 to have substantially the same thickness evenly in a region where any of the small pieces 289*a* to 289*d* is disposed. Moreover, since the small pieces 289*a* to 289*d* have the same thickness, pressure applied when bonding the reservoir unit and the head main body does not vary. Therefore, the reservoir unit and the head main body 2 can be bonded more surely.

Figure 13A:
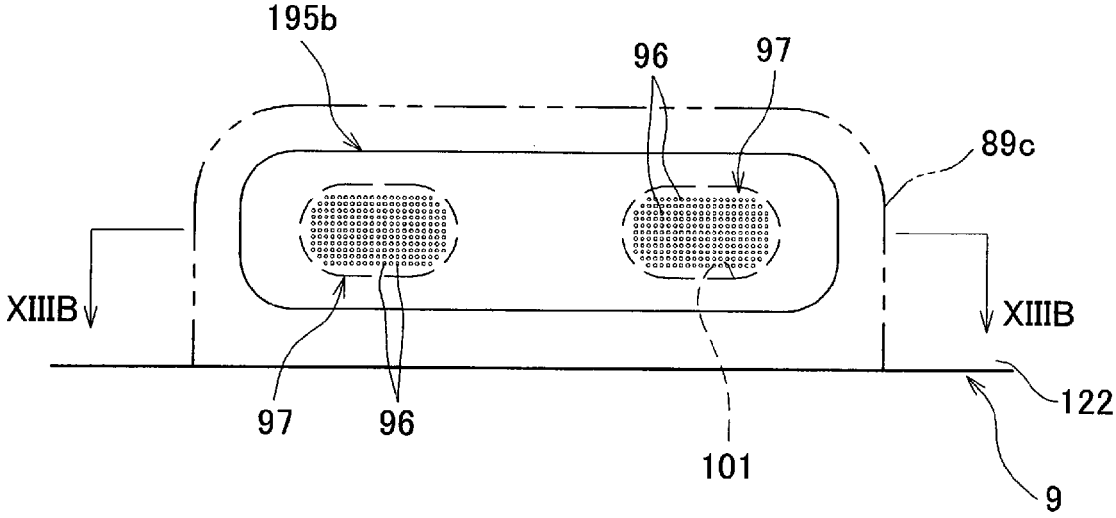
FIG. 13A is a diagram, which corresponds to FIG. 10A, showing a filter plate according to a modification.
Figure 13B:
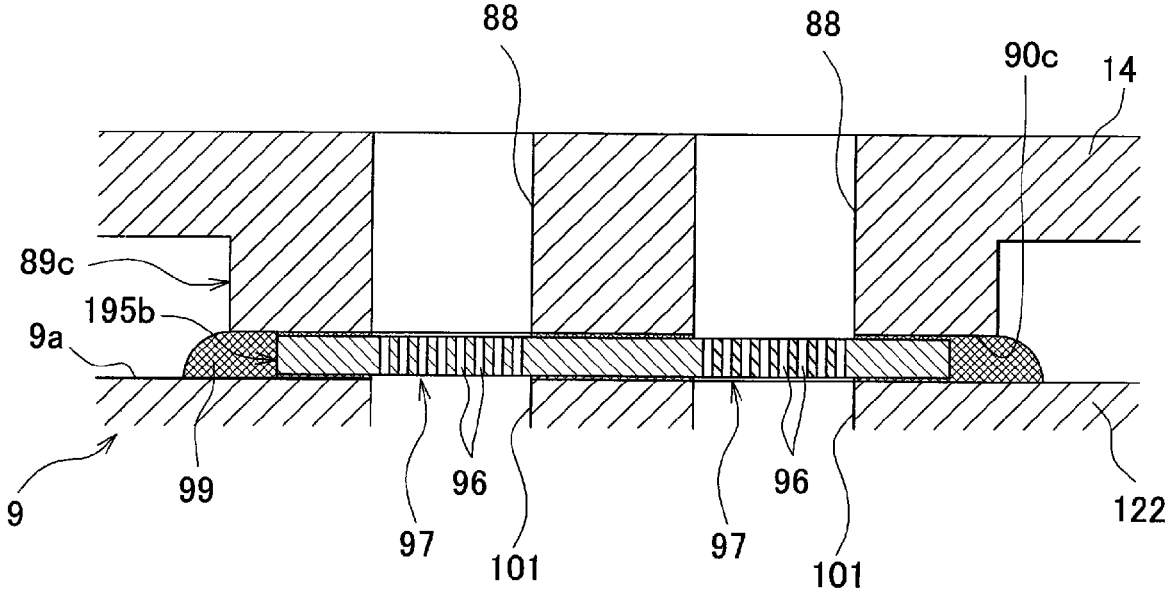
FIG. 13B is a local sectional view as taken along a line XIIIB-XIIIB of FIG. 13A.

Next, with reference to FIGS. 13A and 13B, a modification of the filter plate will be described below. The same members as in the above-described embodiment will be denoted by the same reference numerals, without a specific description thereof.

A filter plate 195*b* of this modification is different from the filter plate 95*b* of the above-described embodiment only in a point that the plate 195 does not have the holes 98 formed therein. That is, the filter plate 195*b* has only the holes 96 formed in the region thereof opposed to the ink supply ports 101 of the passage unit 9 but no holes formed in the other region thereof.

Whereas the adhesive 99 disposed around the filter plate 95*b* and the adhesive 99 filled in the holes 98 contribute to the bonding of the plates 14 and 122, the adhesive 99 disposed around the filter plate 195*b* contributes to the bonding. Even in this case, the above-described effect, i.e., the effect that the plates 14 and 122 are firmly bonded even if adhesion of the adhesive 99 to the filter plates 195*b* is small, is obtained.

A diameter of the hole 98 may be not more than a diameter of the hole 96.

It is not always necessary that the adhesive 99 is disposed in the holes 98 and around the filter plates 95*a* and 95*b*. The adhesive 99 may be disposed either in the holes 98 or around the filter plates 95*a* and 95*b*.

The adhesive 99 that is disposed around the filter plates 95*a* and 95*b* may not be in contact with the outer edges of the filter plates 95*a* and 95*b*.

An interval between each hole 98 and the hole group 97 may not be larger than an interval between neighboring holes 98, insofar as, at the time of bonding the head main body 2 and the reservoir unit, the adhesive 99 filled in the holes 98 hardly spreads out of the upper and lower faces of the filter plates 95*a* and 95*b* which are opposed to the protrusions 89*a* to 89*d* or the small pieces 289*a* to 289*d* and the upper face 9*a* of the passage unit 9.

A thickness of the filter plate may be larger than 8 μm. A material forming inside of the filter plate may not be a metal, insofar as at least a surface of the filter plate is made of a metal.

Applications of the layered structure of the present invention are not limited to ink-jet heads, but may be adopted in anything in which a filter plate is sandwiched between two metal plates having holes so that the respective holes communicate with each other through the filter.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A layered structure comprising:

a first metal plate having a first hole, a second metal plate having a second hole designed to communicate with the first hole, and a filter plate having a filter through which liquid is filtered and at least a surface of which is made of a metal, wherein:

the filter plate is sandwiched between the first and second metal plates so that the first hole and the second hole communicate with each other through the filter;

the first and second metal plates are bonded directly to each other by means of an adhesive that is disposed between the first and second metal plates, and the adhesive contains at least a first portion, the first portion surrounding an outer edge of the filter plate and directly connecting the first and second metal plates with respect to a thickness direction of the first and second metal plates.

2. The layered structure according to claim 1, wherein the first portion of the adhesive is in contact with an outer edge of the filter plate.

3. The layered structure according to claim 1, wherein:

the filter plate has, in its region not opposed to the first and second holes, at least one through hole passing therethrough; and the first and second metal plates are bonded to each other by means of the first portion of the adhesive and a second portion of the adhesive which is filled in the through hole.

4. The layered structure according to claim 3, wherein a diameter of the through hole is larger than a diameter of holes that form the filter.

5. The layered structure according to claim 3, wherein:

the filter plate has a plurality of the through holes that are formed so as to keep out the adhesive from the filter; and each of the through holes locates away from the filter at an interval larger than an interval between neighboring ones of the through holes.

6. The layered structure according to claim 1, wherein a thickness of the filter plate is equal to or less than 8 μm.

7. The layered structure according to claim 1, wherein: a protrusion is formed integral with the first metal plate and protrudes from the first metal plate toward the second metal plate; and the filter plate is sandwiched between an end face of the protrusion and the second metal plate.

8. An ink jet head comprising:

a member where a plurality of nozzles and an ink passage communicating with the nozzles are formed, and a filter plate having a filter through which liquid is filtered and at least a surface of which is made of a metal, wherein:

the member includes a first metal plate having a first hole and a second metal plate having a second hole designed to communicate with the first hole; the first and second holes form the ink passage;

the filter plate is sandwiched between the first and second metal plates so that the first hole and the second hole communicate with each other through the filter;

the first and second metal plates are bonded directly to each other by means of an adhesive that is disposed between the first and second metal plates, and the adhesive contains at least a first portion, the first portion surrounding an outer edge of the filter plate and directly connecting the first and second metal plates with respect to a thickness direction of the first and second metal plates.

9. The ink-jet head according to claim 8, wherein the first portion of the adhesive is in contact with an outer edge of the filter plate.

10. The ink-jet head according to claim 8, wherein:

the filter plate has, in its region not opposed to the first and second holes, at least one through hole passing therethrough; and the first and second metal plates are bonded to each other by means of the first portion of the adhesive and the second portion of the adhesive which is filled in the through hole.

11. The ink-jet head according to claim 10, wherein a diameter of the second plurality of through holes is larger than a diameter of holes that form the filter.

12. The ink-jet head according to claim 10, wherein:

the filter plate has a plurality of the through holes that are formed so as to keep out the adhesive from the filter; and each of the through holes locates away from the filter at an interval larger than an interval between neighboring ones of the through holes.

13. The ink-jet head according to claim 8, wherein a thickness of the filter plate is equal to or less than 8 μm.

14. The ink-jet head according to claim 8, wherein: a protrusion is formed integral with the first metal plate and protrudes from the first metal plate toward the second metal plate; and the filter plate is sandwiched between an end face of the protrusion and the second metal plate.

* * * * *